US008573732B2

(12) United States Patent
Hoshino et al.

(10) Patent No.: US 8,573,732 B2
(45) Date of Patent: Nov. 5, 2013

(54) TREATMENT LIQUID APPLICATION DEVICE AND IMAGE FORMING APPARATUS

(75) Inventors: Seiji Hoshino, Kanagawa (JP); Satoshi Kitaoka, Kanagawa (JP); Shinji Imoto, Tokyo (JP); Hiroyoshi Komaba, Kanagawa (JP); Shozo Sakura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 14 days.

(21) Appl. No.: 13/432,273

(22) Filed: Mar. 28, 2012

(65) Prior Publication Data

US 2012/0262519 A1 Oct. 18, 2012

(30) Foreign Application Priority Data

Apr. 13, 2011 (JP) ..... 2011-088826

(51) Int. Cl.
*B41J 2/015* (2006.01)

(52) U.S. Cl.
USPC ..... 347/21

(58) Field of Classification Search
USPC ..... 347/21
See application file for complete search history.

(56) References Cited

U.S. PATENT DOCUMENTS

| | | | |
|---|---|---|---|
| 2009/0151625 | A1 | 6/2009 | Matsumoto et al. |
| 2010/0245420 | A1 | 9/2010 | Ichimura et al. |
| 2010/0245460 | A1 | 9/2010 | Imoto et al. |
| 2011/0057988 | A1 | 3/2011 | Izumikawa et al. |
| 2011/0220017 | A1 | 9/2011 | Kitaoka et al. |
| 2011/0310185 | A1 | 12/2011 | Komaba et al. |
| 2012/0060754 | A1 | 3/2012 | Kitaoka et al. |

FOREIGN PATENT DOCUMENTS

| | | |
|---|---|---|
| JP | 2006-346534 | 12/2006 |
| JP | 2007-44648 | 2/2007 |
| JP | 2007-44649 | 2/2007 |
| JP | 2007-301814 | 11/2007 |
| JP | 2007-301816 | 11/2007 |
| JP | 2007-301818 | 11/2007 |
| JP | 2008-260307 | 10/2008 |
| JP | 2009-172840 | 8/2009 |
| JP | 2010-69442 | 4/2010 |
| JP | 2010-194526 | 9/2010 |

OTHER PUBLICATIONS

U.S. Appl. No. 13/315,537, filed Dec. 9, 2011.

*Primary Examiner* — Matthew Luu
*Assistant Examiner* — Justin Seo
(74) *Attorney, Agent, or Firm* — Cooper & Dunham LLP

(57) ABSTRACT

A treatment-liquid application device includes a treatment-liquid container, a liquid supply unit, a liquid chamber unit, a treatment-liquid carrier, a transport unit, a treatment-liquid applicator, and a partition. The partition is disposed in an area of the chamber unit defined by an imaginary entry plane, an imaginary exit plane, a carrying surface of the carrier, and a bottom face of the chamber unit. The entry plane includes an entry line at which the carrying surface enters treatment liquid in the chamber unit, and vertically extends from the entry line. The exit plane includes an exit line at which the carrying surface exits from the liquid in the chamber unit, and vertically extends from the exit line. The partition extends in a longitudinal direction of the carrier and has an edge portion adjacent to the carrying surface.

17 Claims, 6 Drawing Sheets

TREATMENT LIQUID APPLICATION DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2011-088826, filed on Apr. 13, 2011, in the Japan Patent Office, the entire disclosure of which is hereby incorporated by reference herein.

BACKGROUND

1. Technical Field

This disclosure relates to a treatment-liquid application device and an image forming apparatus, and more specifically to a treatment-liquid application device that applies treatment liquid to treatment-liquid application targets, such as image recording media, and an image forming apparatus including the treatment-liquid application device.

2. Description of the Related Art

Image forming apparatuses are known as, for example, printers, facsimile machines, copiers, plotters, or multi-functional devices having two or more of the foregoing capabilities, and different types of image forming methods for the image forming apparatuses are also known. As one type of image forming apparatus, for example, image forming apparatuses employing a liquid-ejection recording method are known that use at least one recording head to eject droplets of ink. During image formation, such liquid-ejection-type image forming apparatuses eject droplets of ink or other liquid from the recording head onto an image recording medium to form (record or print) a desired image to the image recording medium.

The term "image recording medium" used herein is not limited to a sheet of paper but includes an OHP (overhead projector) sheet or anything on which liquid, e.g., ink droplets, or solid, e.g., toner particles, constituting images can be adhered. In other words, the term "image recording medium" is used as a generic term including a recording medium, a recorded medium, a recording sheet, and a recording sheet of paper.

Such liquid-ejection-type image forming apparatuses fall into two main types: a serial-type image forming apparatus that forms an image by ejecting droplets from the recording head while moving the recording head in a main scanning direction of the carriage, and a line-head-type image forming apparatus that forms an image by ejecting droplets from a linear-shaped recording head held stationary in the image forming apparatus.

Such a liquid-ejection-type image forming apparatus may have image failures, such as "feathering" in which dots formed with liquid droplets blur in a jaggy shape on the image recording medium and "color bleeding" in which different types of liquid droplets (e.g., ink droplets of different colors) mix each other at adjacent areas on the image recording medium to blur color boundaries. Such a liquid-ejection-type image forming apparatus may also take a relatively long time to dry liquid droplets on the image recording medium after image formation.

To minimize such failures, conventionally, a prescribed treatment liquid may be applied to the image recording medium before image formation to minimize migration of liquid droplets landed on the image recording medium or reduce the drying time of liquid droplets landed on the image recording medium.

For example, JP2008-260307-A, JP2007-301814-A, and JP2010-194526-A propose that a treatment liquid for reacting to ink to minimize image or color bleeding is applied to an image recording medium with an application roller before image formation. In a treatment-liquid application device described in JP2008-260307-A, a scooping roller serving as a treatment-liquid carrier rotates and the roller surface of the scooping roller moves in and out a treatment liquid in a direction perpendicular to the roller shaft while entering and soaking in the treatment liquid stored in a treatment liquid tank of a liquid chamber, thus scooping the treatment liquid. When the roller surface of the scooping roller indirectly contacts the roller surface of an application roller serving as a treatment-liquid applicator via a film-thickness control roller, the treatment liquid on the roller surface of the scooping roller is applied to the roller surface of the application roller. When a transport roller serving as a transport unit transports the image recording medium serving as a treatment-liquid application target so as to pass a nipping portion between the application roller and the transport roller, the treatment liquid on the roller surface of the application roller is adjusted to a certain thickness and applied to the image recording medium. Surplus treatment liquid on the application roller is transferred onto the scooping roller indirectly contacting the application roller, and the scooping roller passes the treatment liquid stored in the liquid chamber to return the surplus treatment liquid to the treatment liquid stored in the liquid chamber.

Alternatively, in JP2007-301814-A and JP2010-194526-A, after transfer of the treatment liquid onto the image recording medium, a blade-shaped cleaning member contacts the roller surface of the application roller to collect surplus treatment liquid remaining on the roller surface of the application roller after the transfer.

However, in JP2008-260307-A, foreign matter adhered to the image recording medium, e.g., paper dust adhered to a sheet of paper is transferred onto the roller surface of the application roller at the nipping portion between the application roller and the transport roller, and further transferred onto the scooping roller indirectly contacting the application roller. When the scooping roller enters and passes the treatment liquid in the liquid chamber, a vortex is generated in the liquid chamber by friction of the roller surface of the scooping roller with the treatment liquid. Although the foreign matter can be separated and removed from the roller surface of the scooping roller by the shearing force of the vortex, foreign matter remains in the treatment liquid of the treatment liquid tank. The foreign matter in the treatment liquid is agitated by the vortex in the treatment liquid tank without settling at the bottom of the liquid chamber, thus increasing contamination of the treatment liquid in the liquid chamber.

Alternatively, in JP2007-301814-A and JP2010-194526-A, by contacting a blade-shaped cleaning member with the roller surface of the application roller adhered with foreign matter such as paper dust, the treatment liquid including the foreign matter can be collected and removed from the roller surface. However, friction dust occurs due to the friction of the blade-shaped cleaning member with the roller surface of the application roller, and adheres to the roller surface of the application roller. When the cleaning member contacts the adhered friction dust, the friction dust separates and detaches from the roller surface of the application roller, floats in the air, and adheres to the image recording medium. As a result, if an image is formed on the image recording medium having the adhered friction dust, the friction dust may separate from the image recording medium, thus causing missing of requisite image elements. Alternatively, the friction dust permeated with ink may migrate over the image recording medium, thus degrading the image surface. Additionally, such friction dust may mix into the treatment liquid stored in the liquid chamber and increasingly contaminate the treatment liquid, resulting in a reduced treatment performance of the treatment liquid.

BRIEF SUMMARY

In an aspect of this disclosure, there is provided a treatment-liquid application device including a treatment-liquid container, a liquid supply unit, a liquid chamber unit, a treatment-liquid carrier, a transport unit, a treatment-liquid applicator, and a partition. The treatment-liquid container stores a treatment liquid. The liquid supply unit supplies the treatment liquid from the treatment-liquid container. The liquid chamber unit stores the treatment liquid supplied from the treatment-liquid container. The treatment-liquid carrier has a carrying surface movable into and out from the treatment liquid stored in the liquid chamber unit to carry the treatment liquid. The transport unit transports an application target to an application position. The treatment-liquid applicator applies the treatment liquid transferred from the treatment-liquid carrier, to the application target at the application position. The partition is disposed in an area of the liquid chamber unit defined by an imaginary entry plane, an imaginary exit plane, the carrying surface, and a bottom face of the liquid chamber unit. The imaginary entry plane includes an entry line at which the carrying surface of the treatment-liquid carrier enters the treatment liquid stored in the liquid chamber unit. The imaginary entry plane vertically extends from the entry line. The imaginary exit plane includes an exit line at which the carrying surface of the treatment-liquid carrier exits from the treatment liquid stored in the liquid chamber unit. The imaginary exit plane vertically extends from the exit line. The partition extends in a longitudinal direction of the treatment-liquid carrier perpendicular to a moving direction of the carrying surface of the treatment-liquid carrier. The partition has an edge portion adjacent to the carrying surface of the treatment-liquid carrier.

In another aspect of this disclosure, there is provided a treatment-liquid application device including a treatment-liquid container, a liquid supply unit, a liquid chamber unit, a treatment-liquid carrier, a transport unit, a treatment-liquid applicator, and a partition. The treatment-liquid container stores a treatment liquid. The liquid supply unit supplies the treatment liquid from the treatment-liquid container. The liquid chamber unit stores the treatment liquid supplied from the treatment-liquid container. The treatment-liquid carrier has a carrying surface movable into and out from the treatment liquid stored in the liquid chamber unit to carry the treatment liquid. The transport unit transports an application target to an application position. The treatment-liquid applicator applies the treatment liquid transferred from the treatment-liquid carrier, to the application target at the application position. The partition is disposed in the liquid chamber unit to partition the liquid chamber unit into upstream and downstream chambers in a moving direction of the carrying surface of the treatment-liquid carrier. The partition extends in a longitudinal direction of the treatment-liquid carrier perpendicular to the moving direction of the carrying surface of the treatment-liquid carrier. The partition has an edge portion adjacent to the carrying surface of the treatment-liquid carrier.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
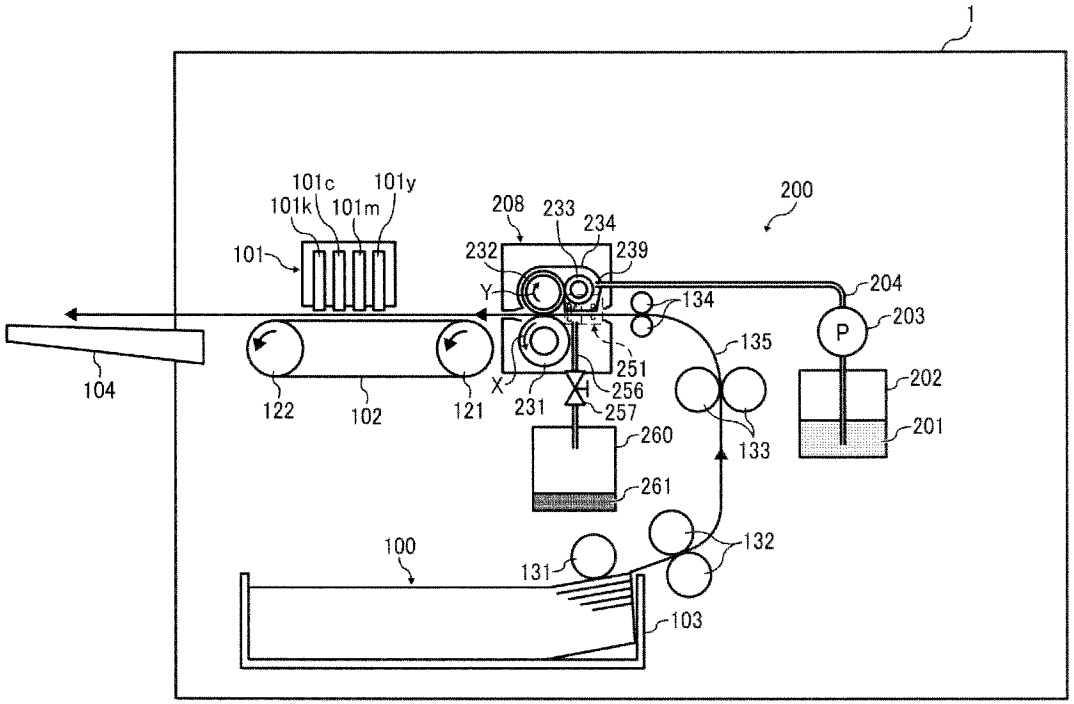
FIG. 1 is a front view of an image forming apparatus including a treatment-liquid application device according to a first exemplary embodiment.

The accompanying drawings are intended to depict exemplary embodiments of the present disclosure and should not be interpreted to limit the scope thereof The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "liquid-ejection-type image forming apparatus" refers to an apparatus (e.g., droplet ejection apparatus or liquid ejection apparatus) that ejects ink or any other liquid onto an image recording medium to form an image on the medium. The image recording medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the image recording medium (in other words, the term "image formation" includes only causing liquid droplets to land on the image recording medium). The term "ink" used herein is not limited to "ink" in a narrow sense and is a generic term covering anything ejected in a liquid form, such as a DNA sample, resist, and pattern material. The term "image" used herein is not limited to an image applied to a plane but includes, for example, an image applied to a three dimensional object and a three dimensional object itself formed as a three-dimensionally molded image. Although a liquid-ejection-type image forming apparatus that ejects ink is described below as an example of liquid-ejection-type image forming apparatus, the term "image forming apparatus" used herein is not limited to the liquid-ejection-type image forming apparatus that ejects ink but may be, for example, electrophotographic image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Figure 2:
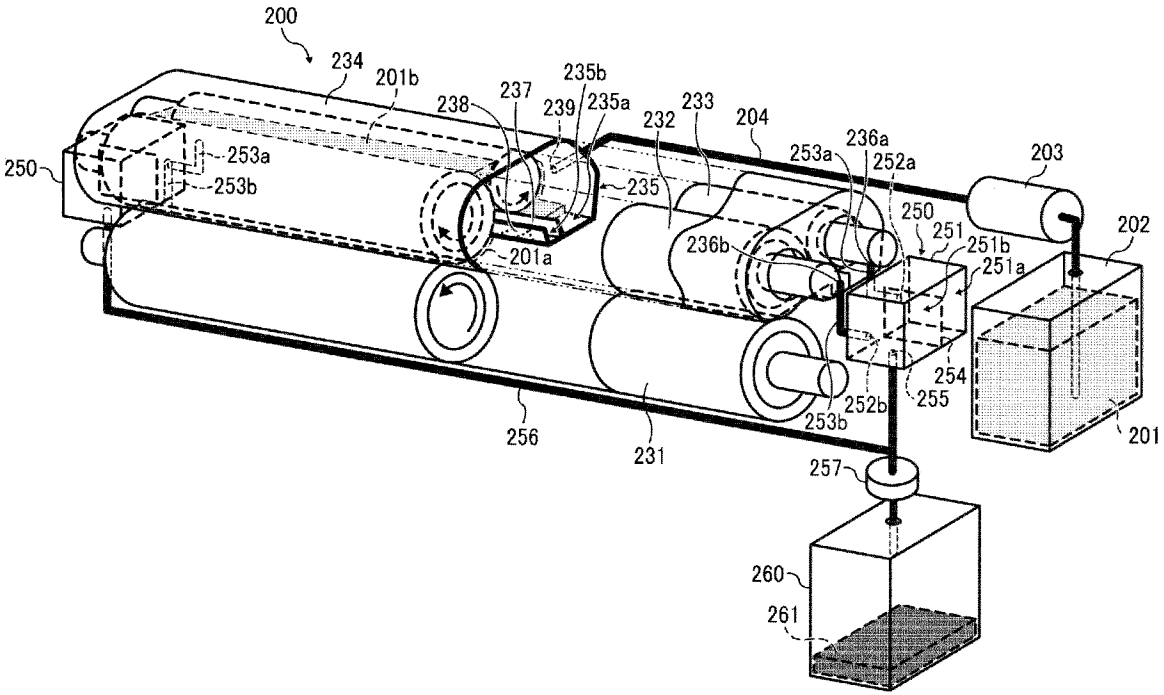
FIG. 2 is a transparent perspective view of the treatment-liquid application device of FIG. 1.
Figure 3:
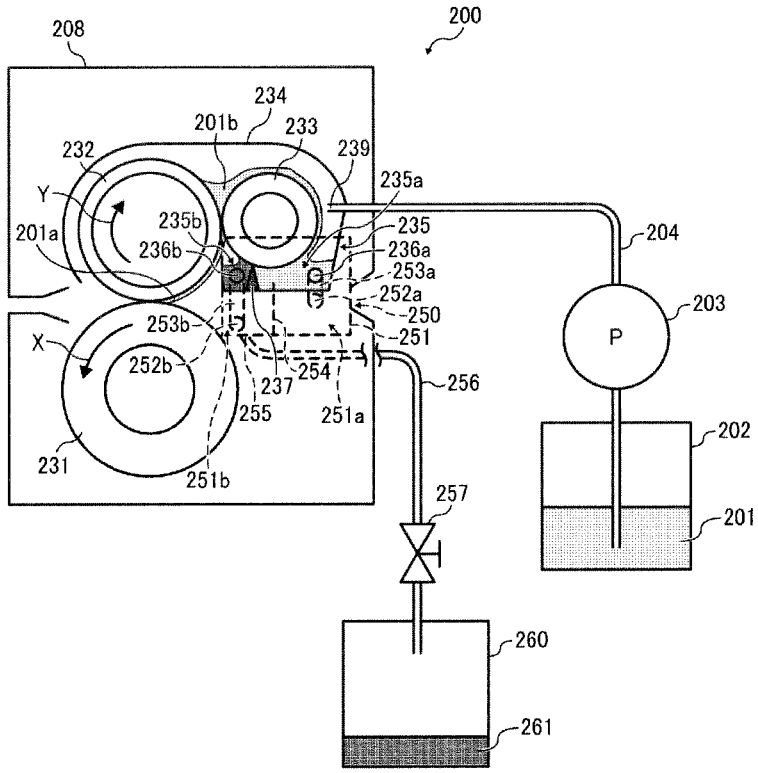
FIG. 3 is a partial front view of the treatment-liquid application device of FIG. 1.
Figure 4:
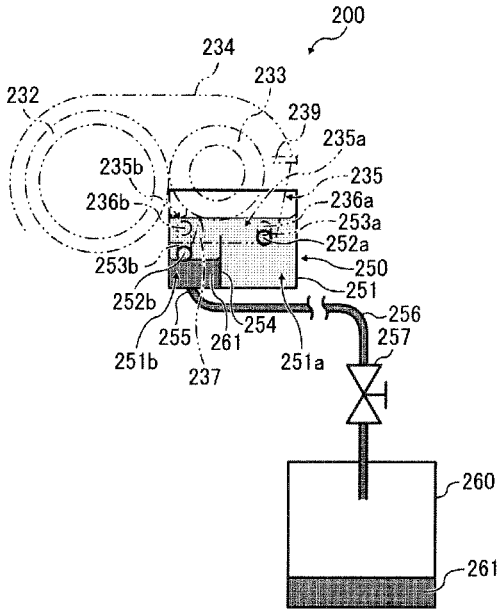
FIG. 4 is a partially transparent side view of the treatment-liquid application device of FIG. 1.

FIG. 1 is a front view of an image forming apparatus including a treatment-liquid application device according to a first exemplary embodiment. FIG. 2 is a transparent perspective view of the treatment-liquid application device of FIG. 1. FIG. 3 is a partial front view of the treatment-liquid application device of FIG. 1. FIG. 4 is a partially transparent side view of the treatment-liquid application device of FIG. 1.

In FIG. 1, an image forming apparatus 1 has a recording head assembly 101, a conveyance belt 102, a sheet feed tray 103, and a treatment-liquid application device 200. The recording head assembly 101 serves as an image forming device that forms an image on a sheet 100 serving as an image recording medium by ejecting droplets of liquid onto the sheet 100. The conveyance belt 102 conveys the sheet 100, and the sheet feed tray 103 stores the sheets 100 fed to the conveyance belt 102. The treatment-liquid application device 200 serves as the treatment-liquid application device according to this exemplary embodiment to apply treatment liquid to the sheet 100 at a position upstream from the recording head assembly 101 in a direction in which the sheet 100 is transported (hereinafter, sheet transport direction).

The recording head assembly 101 includes at least one line-type liquid ejection head. Each liquid ejection head has at least one nozzle row of multiple nozzles through which to eject liquid droplets. In each nozzle row, the multiple nozzles are arrayed in a range corresponding to, e.g., a maximum width of recording media available for the image forming apparatus 1. As illustrated in FIG. 1, the recording head assembly 101 includes, for example, recording heads 101*y*, 101*m*, 101*c*, and 101*k* to eject ink droplets of yellow (Y), magenta (M), cyan (C), and black (K). Alternatively, the image forming apparatus may be a serial-type image forming apparatus in which such a recording head assembly is mounted on a movable carriage.

The conveyance belt 102 is an endless belt looped between a conveyance roller 121 and a tension roller 122 for circulation. The sheet 100 may be retained on the conveyance belt 102 by electrostatic adhesion, air aspiration, or any other method. Alternatively, any other conveyance device may be employed to convey the sheet 100. For example, the sheet 100 may be conveyed by a conveyance device including paired rollers.

From a stack of sheets 100 stored in the sheet feed tray 103, the sheet 100 is separated by a pick-up roller 131 and fed by paired feed rollers 132 to paired registration rollers 133. The sheet 100 fed from the paired registration rollers 133 is further fed by paired feed rollers 134 to the treatment-liquid application device 200 via a transport passage 135, and the treatment-liquid application device 200 applies treatment liquid to the sheet 100. The sheet 100 applied with treatment liquid is sent onto the conveyance belt 102 and retained on the conveyance belt 102. When the sheet 100 is conveyed to a recording area with circulation of the conveyance belt 102, the recording head assembly 101 ejects liquid droplets of respective colors onto the sheet 100 to form a desired image on the sheet 100. The sheet 100 having the image thereon is output to a sheet output tray 104.

As illustrated in FIGS. 1 to 4, the treatment-liquid application device 200 according to this exemplary embodiment includes, for example, a new treatment liquid container 202 to store treatment liquid 201, a pump 203 to pressure feed the treatment liquid 201 from the new treatment liquid container 202, an applicator assembly 208 to apply to the sheet 100 the treatment liquid 201 supplied by the pump 203 via a supply channel 204. The treatment liquid 201 is a modifier applied to a surface of the sheet 100 to modify the surface of the sheet 100. For example, the treatment liquid 201 may be a fixing agent (setting agent) that is uniformly applied over the sheet 100 before image formation to cause the moisture of ink to promptly penetrate into the sheet 100, increase the viscosity of color components, and speed up drying of ink, thus preventing feathering, bleeding, and/or offset of ink and enhancing the productivity (e.g., the number of image outputs per unit time). Regarding the composition, for example, the treatment liquid 201 may be a solution containing a surface acting agent (for example, an anionic, cationic, or nonionic agent or a mixed agent including two or more of the foregoing types), a cellulosic material (e.g., hydroxypropyl cellulose) for facilitating the penetration of moisture, and a base material such as talc powder. Further, the solution may contain fine particles.

The applicator assembly 208 includes a transport roller 231, an application roller 232, a squeeze roller 233, a housing member 234, and an application liquid chamber unit 235. The transport roller 231 transports the sheet 100, and the application roller 232 is disposed opposing the transport roller 231 to apply the treatment liquid 201 onto the sheet 100. The squeeze roller 233 contacts the treatment liquid 201 in the application liquid chamber unit 235, carries the treatment liquid 201 on its surface, and transfers the treatment liquid 201 onto a roller surface of the application roller 232 while spreading the treatment liquid 201 into a thin liquid layer (film) on the roller surface of the application roller 232. The housing member 234 includes the application liquid chamber unit 235 that supplies and collects the treatment liquid 201. The transport roller 231, the application roller 232, and the squeeze roller 233 rotate in the directions indicated by arrows X, Y, and Z, respectively, in FIG. 5.

The transport roller 231, the application roller 232, and the squeeze roller 233 are arranged so that the application roller 232 contacts the transport roller 231 and the squeeze roller 233 contacts the application roller 232. The squeeze roller 233 is arranged so as to soak into the treatment liquid 201 in the application liquid chamber unit 235.

In a step of applying the treatment liquid, rotating the squeeze roller 233 causes the treatment liquid 201 to be carried from the application liquid chamber unit 235, and a treatment liquid accumulation 201*b* is formed in a valley area between the squeeze roller 233 and the application roller 232. At the treatment liquid accumulation 201*b*, the application roller 232 and the squeeze roller 233 contact with pressure each other. As a result, when the treatment liquid accumulation 201*b* passes a nipping portion (contact portion) between the squeeze roller 233 and the application roller 232, the treatment liquid accumulation 201*b* is turned into a thin liquid layer 201*a*. Thus, the treatment liquid 201 is applied onto an image recording medium passing between the transport roller 231 and the application roller 232. A portion of treatment liquid having not applied in, e.g., areas between pages of the sheets 100 serving as the image recording media or areas outside a recording area in the main scanning (width) direction is accumulated in a second application liquid chamber 235*b*. Additionally, from a slight clearance on top of a partition 237, a portion of treatment liquid may flow into a first application liquid chamber 235*a*. The second application liquid chamber 235*b* also communicates with the first application liquid chamber 235*a* via a collection liquid chamber unit 251. As a result, at the stopped state, the liquid level of the second application liquid chamber 235*b* becomes equal to that of the first application liquid chamber 235*a*.

In the above-described application structure of treatment liquid illustrated in FIGS. 1 to 4, after the treatment liquid of the thin liquid layer 201*a* is transferred/applied from the application roller 232 to the sheet 100, foreign matter, in particular, paper dust adhering on the sheet 100, is likely to adhere to a wet surface of the application roller 232. Therefore, if the wet surface of the application roller 232 contacts the squeeze roller 233, foreign matter or paper dust would transfer and adhere to the squeeze roller 233. Furthermore, if such foreign matter or paper dust is rinsed with the treatment liquid 201 in the application liquid chamber unit 235, the foreign matter or paper dust would separate from the squeeze roller 233 and contaminate the treatment liquid 201 in the application liquid chamber unit 235.

If such a contaminated state of treatment liquid 201 is used, foreign matter or paper dust is likely to adhere to a recording face of the sheet 100. As a result, the landing performance of ink droplets ejected by the recording head assembly 101 downstream from the applicator assembly 208 in the sheet transport direction would decrease, thus degrading image quality or causing image failure. In particular, if ink droplets having landed on foreign matter or paper dust adhered on the surface of the sheet 100 migrates elsewhere, required image elements would miss. Alternatively, foreign matter or paper dust permeated with ink droplets might rub against or adhere to different positions of the surface of an image formed on the sheet 100. Furthermore, if contamination of the treatment liquid 201 further increases, the function of the treatment liquid 201 as treatment liquid might be modified, resulting in a reduced treatment performance.

To prevent such failures, the treatment liquid 201 in the application liquid chamber unit 235 need be appropriately replaced with new one according to the number of sheets 100 processed or a predetermined elapsed time. Hence, a waste treatment liquid 206 is discharged from a drain port 255 to a waste treatment liquid chamber 260 via a drain channel 256 and a drain valve 257. For replenishment of new treatment liquid, driving the pump 203 causes a proper amount of treatment liquid 201 to be supplied from the new treatment liquid container 202 to the application liquid chamber unit 235 via the supply channel 204 and a supply port 239. However, if, before discharge, foreign matter or paper dust included in contaminated treatment liquid in the application liquid chamber unit 235 sinks over time and accumulates at the bottom of the application liquid chamber unit 235, the foreign matter or paper dust may gradually increase its viscosity and settle at the bottom without being discharged. In such a state, if new treatment liquid 201 is poured in the application liquid chamber unit 235, the new treatment liquid 201 would be contaminated, thus causing the above-described failures.

Hence, as illustrated in FIGS. 1 to 4, the treatment-liquid application device according to this exemplary embodiment has the partition 237 standing on a bottom face of the application liquid chamber unit 235 storing the treatment liquid 201 so that the squeeze roller 233 can soak the treatment liquid 201. The partition 237 has such a height as to create a slight clearance between the partition 237 and the surface of the squeeze roller 233 at a side close to the application roller 232 relative to a vertical line passing the central axis of the squeeze roller 233 in a side view (e.g., FIG. 3). In other words, from the bottom face of the application liquid chamber unit 235, the partition 237 has such a height that an upper edge thereof is disposed adjacent to the surface of the squeeze roller 233 without contacting the surface. Through the clearance between the partition 237 and the surface of the squeeze roller 233, the treatment liquid flows from the second application liquid chamber 235*b* to the first application liquid chamber 235*a*. The partition 237 serves as a boundary between the first application liquid chamber 235*a* and the second application liquid chamber 235*b* that are first and second chambers of the application liquid chamber unit 235 downstream and upstream, respectively, in the rotation phase of the squeeze roller 233. Thus, the partition 237 is arranged so as to separate the first application liquid chamber 235*a* (the squeeze-roller side chamber) distal to the application roller 232 from the second application liquid chamber 235*b* (the application-roller side chamber) proximal to the application roller 232.

The partition 237 is disposed in an area in which the roller surface of the squeeze roller 233 can soak the treatment liquid in the application liquid chamber unit 235. In other words, the partition 237 is disposed in an area of the application liquid chamber unit 235 defined by an imaginary entry plane, an imaginary exit plane, the roller surface of the squeeze roller 233, and the bottom face of the application liquid chamber unit 235. The imaginary entry plane includes an entry line at which the roller surface of the squeeze roller 233 enters the treatment liquid stored in the application liquid chamber unit 235, and the entry plane vertically extends from the entry line. The imaginary exit plane includes an exit line at which the roller surface of the squeeze roller 233 exits from the treatment liquid stored in the application liquid chamber unit 235, and the exit plane vertically extends from the exit line.

In this exemplary embodiment, as described above, the treatment-liquid carrier and the treatment-liquid applicator are rollers. However, it is to be noted that the treatment-liquid carrier and the treatment-liquid applicator are not limited to the above-described rollers but may be, for example, endless belts.

Figure 5:
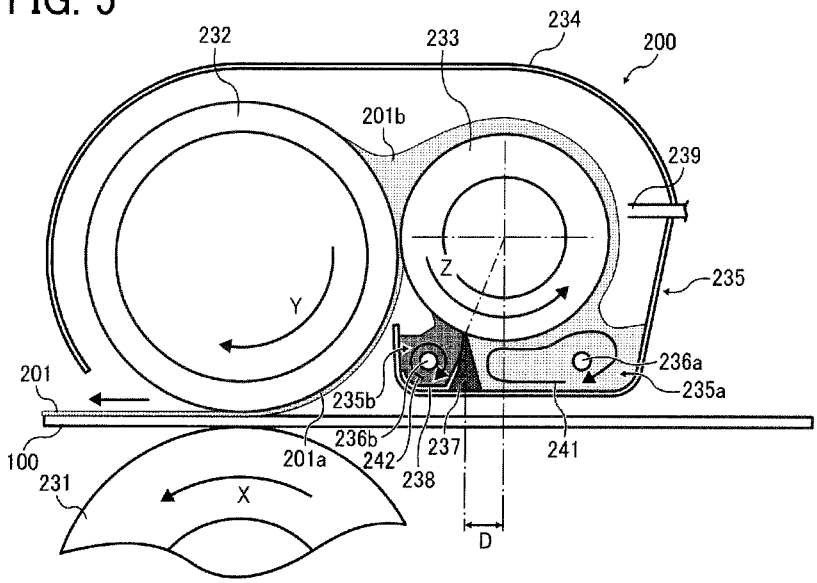
FIG. 5 is a partially enlarged sectional view of the treatment-liquid application device of FIG. 1.

As illustrated in FIG. 5, the partition 237 allows an agitation flow, such as a first liquid chamber vortex 241, to be generated in the treatment liquid 201 in the first application liquid chamber 235*a* with the rotation of the squeeze roller 233. The treatment liquid 201 wetting the surface of the squeeze roller 233 contacts the application roller 232 to form the treatment liquid accumulation 201*b*. As a result, when the treatment liquid accumulation 201*b* passes the nipping portion (contact portion) between the squeeze roller 233 and the application roller 232, the treatment liquid accumulation 201*b* is turned into the thin liquid layer 201*a*. Thus, the treatment liquid 201 of the thin liquid layer 201*a* is applied to the sheet 100 passing between the transport roller 231 and the application roller 232.

Relative to a position vertically downward from the rotation center of the squeeze roller 233, the partition 237 is positioned at the entry side at which the roller surface of the squeeze roller 233 enters the treatment liquid stored in the application liquid chamber unit 235. For example, as illustrated in FIG. 5, in a cross section of the treatment-liquid application device 200 cut along a direction perpendicular to the longitudinal direction of the squeeze roller 233, the partition 237 is disposed at the entry side so as to have a distance D between a vertical line downward from the top of the partition 237 adjacent to the roller surface of the squeeze roller 233 and a vertical line downward from the rotation center of the squeeze roller 233.

With further rotation of the squeeze roller 233, the angular phase of the surface of the squeeze roller 233 arrives at the second application liquid chamber 235*b*. A cross-sectional shape of a side of the partition 237 facing the second application liquid chamber 235*b*, a cross-sectional shape of the chamber side of the second application liquid chamber 235*b*, and the rotation of the squeeze roller 233 in combination creates a second liquid chamber vortex 242 in the treatment liquid 201 stored in the second application liquid chamber 235*b*.

The second liquid chamber vortex 242 stirs the treatment liquid 201 stored in the second application liquid chamber 235*b* having a relatively small space, thus increasing the flow speed. As illustrated in FIG. 5, the partition 237 is disposed at such a position that the volume of the second application liquid chamber 235*b* becomes smaller than that of the first application liquid chamber 235*a*. Also, as illustrated in FIG. 5, the partition 237 is positioned at the entry side of the roller surface of the squeeze roller 233 relative to the position vertically downward from the rotation center of the squeeze roller 233. As a result, a shearing force of the second liquid chamber vortex 242 generated in the second application liquid chamber 235*b* becomes greater than that of the first liquid chamber vortex 241 generated in the first application liquid chamber 235*a*. Thus, the shearing force generated on the surface of the squeeze roller 233 by the second liquid chamber vortex 242 facilitates separation of foreign matter or paper dust adhered to the squeeze roller 233.

Figure 6:
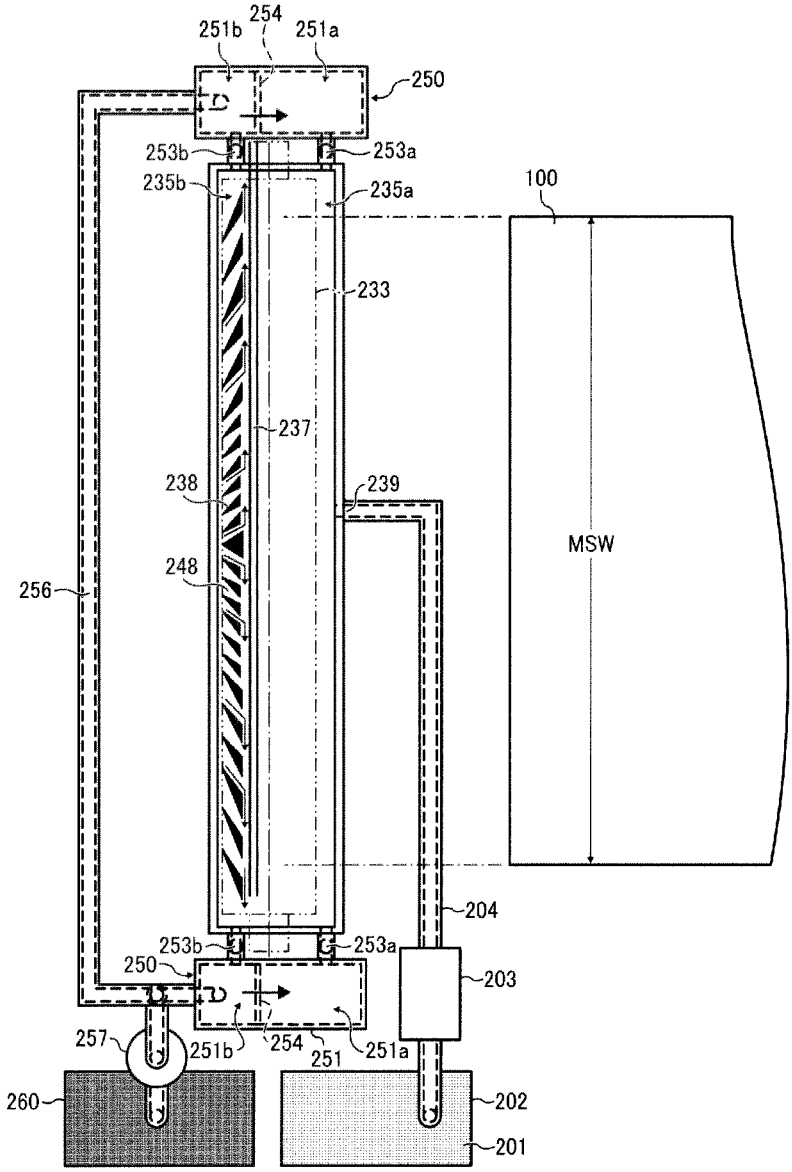
FIG. 6 is a plan view of the treatment-liquid application device of FIG. 1.

As illustrated in FIG. 5, second application liquid chamber ports 236*b* are open at both ends of the second application liquid chamber 235*b* in the longitudinal direction of the squeeze roller 233 to communicate with second collection channels 253*b*. As illustrated in FIG. 6, the treatment liquid 201 stored in the second application liquid chamber 235*b* passes through the second collection channels 253*b* and enters second collection liquid chambers 251*b* forming part of collection units 250 via second collection liquid chamber ports 252*b*.

As illustrated in FIG. 4, each collection unit 250 has a collection liquid chamber partition 254 standing on a bottom face of the collection liquid chamber unit 251 to separate a first collection liquid chamber 251*a* from the second collection liquid chamber 251*b*. The height of the collection liquid chamber partition 254 is set to be lower than the liquid level of the treatment liquid stored in each of the first application liquid chamber 235*a* and the second application liquid chamber 235*b*. The first collection liquid chamber 251*a* constantly communicates with the second collection liquid chamber 251*b* so that the hydraulic head of the treatment liquid in the first collection liquid chamber 251*a* levels to that of the treatment liquid in the second application liquid chamber 235*b*. The second collection liquid chamber port 252*b* communicating with the second application liquid chamber 235*b* is disposed at a position lower than the first collection liquid chamber port 252*a* communicating with the first application liquid chamber 235*a* so as to create a hydraulic head difference. Such a configuration can prevent, e.g., foreign matter or paper dust having settled at the bottom of the second application liquid chamber 235*b* from entering the first application liquid chamber 235*a*.

As illustrated in FIGS. 2 to 4, the second application liquid chamber 235*b* has the drain port 255 at the bottom portion thereof to discharge settled foreign matter to the waste treatment liquid chamber 260 through the drain channel 256. The discharge is controlled with the drain valve 257 mounted on the drain channel 256, and when the drain valve 257 is opened, settled foreign matter is discharged to the waste treatment liquid chamber 260.

As described above, the treatment liquid application device 200 has a foreign matter draining assembly each including the collection liquid chamber unit 251, the collection liquid chamber partition 254 functioning as an internal labyrinth of the collection liquid chamber unit 251, and the waste treatment liquid chamber 260. The collection liquid chamber unit 251 serves as a chamber to reduce the flow speed of liquid running from the second application liquid chamber 235*b*. Such a configuration minimizes contamination of paper dust or other foreign matter to the treatment liquid in the first application liquid chamber 235*a*, thus allowing the treatment liquid to be stored in non- or less-contaminated state.

As illustrated in FIG. 6, the treatment-liquid application device 200 according to this exemplary embodiment has regulation plates 238 that are convex portions at the bottom of the second application liquid chamber 235*b* and serve as regulation members to regulate the flow direction of the treatment liquid 201 in the second application liquid chamber 235*b*. In FIG. 5, a cross section of one of the regulation plates 238 is illustrated. Additionally, as illustrated in FIG. 6, the regulation plates 238 are arranged in line symmetry with respect to a triangle one of the regulation plates 238 at the center in the longitudinal direction of the second application liquid chamber 235*b* (the vertical direction in FIG. 6). The cross-sectional area of the second application liquid chamber 235*b* at slit portions (channels) 248 between adjacent regulation plates 238 in the longitudinal direction of the second application liquid chamber 235*b* is greater than that of the second application liquid chamber 235*b* at the convex portions of the regulation plates 238. As a result, the flow speed of the treatment liquid 201 becomes lower at the slit portions 248. By contrast, the cross-sectional area of the second application liquid chamber 235*b* at the convex portions of the regulation plates 238 is smaller than that of the second application liquid chamber 235*b* at the slit portions 248 between the regulation plates 238. As a result, the flow speed of the treatment liquid 201 becomes higher at the convex portions of the regulation plates 238. The difference in flow speed allows the second liquid chamber vortex 242 to more effectively agitate paper dust or foreign matter having sunk in the second application liquid chamber 235*b*.

Additionally, as the regulation plates 238 are farther from the triangle one at the center position in the longitudinal direction of the second application liquid chamber 235*b*, the inclination angle of the regulation plates 238 relative to the partition 237 decreases. Such a structure increases the vector of liquid flow in the longitudinal direction of the second application liquid chamber 235*b* (the vertical direction in FIG. 6). As a result, as the treatment liquid approaches each end in the longitudinal direction of the second application liquid chamber 235*b*, the flow amount and speed of treatment liquid increases, thus, increasing pressure toward the second application liquid chamber ports 236*b* at both ends in the longitudinal direction of the second application liquid chamber 235*b*. Such a structure provides a channel shape capable of obtaining a faster flow speed at the downstream side than the upstream side in the flow direction of the treatment liquid.

As described above, the second application liquid chamber 235*b* includes the regulation plates 238. The shape (structure) of the regulation plates 238 allows stirring of paper dust or foreign matter having sunk in the second application liquid chamber 235*b*, and constantly creates liquid flow to apply pressure toward outer sides in the second application liquid chamber 235*b*. Such a configuration prevents settlement of foreign matter, thus minimizing entry of foreign matter into the treatment liquid 201 in the second application liquid chamber 235*b*.

As illustrated in FIG. 6, by providing the collection liquid chambers 251 serving as the foreign matter draining assemblies separately at both sides in the longitudinal direction of the second application liquid chamber 235*b*, independent foreign matter draining assemblies are provided at both ends of the first application liquid chamber and the second application liquid chamber 235*b*. Such a configuration can prevent uneven contamination of the treatment liquid 201 at both ends in the longitudinal direction of the squeeze roller 233 (the vertical direction in FIG. 6) and promptly remove foreign matter from two points.

Figure 7:
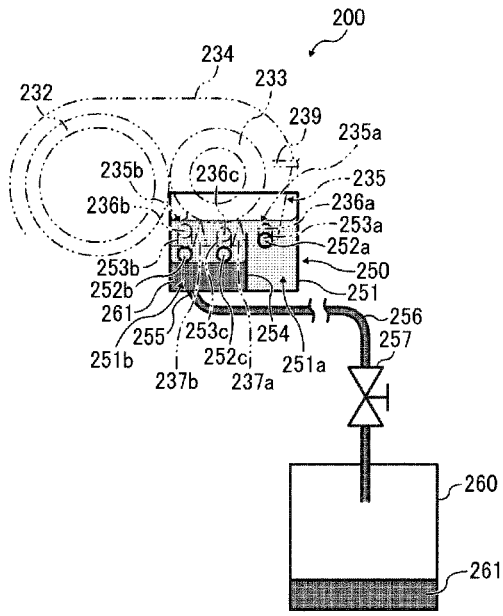
FIG. 7 is a partially transparent side view of a variation example of treatment-liquid application device.
Figure 8:
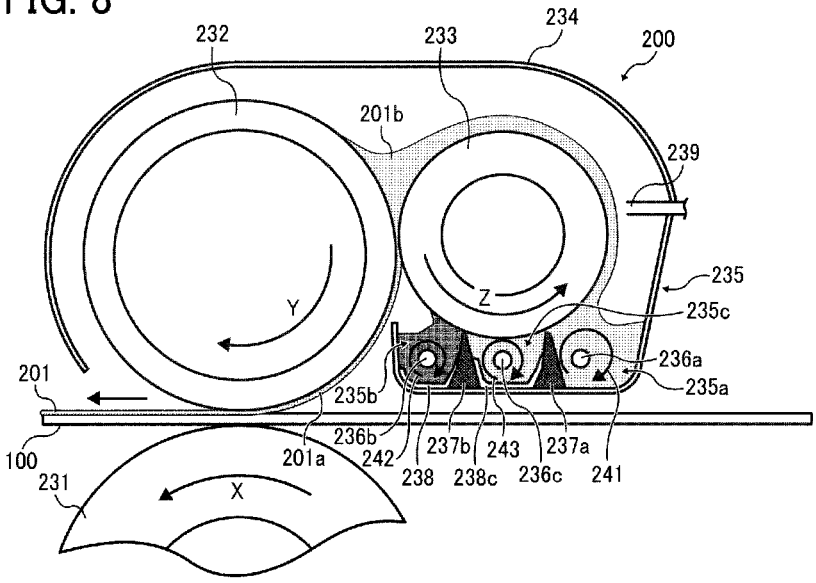
FIG. 8 is a partially enlarged sectional view of the variation example of treatment-liquid application device illustrated in FIG. 7.

In one variation example, as illustrated in FIGS. 7 and 8, the application liquid chamber unit 235 has a first partition 237*a* and a second partition 237*b*. The second partition 237*b* corresponding to the above-described partition 237 separates a first application liquid chamber 235*a* from a second application liquid chamber 235*b*. The first partition 237*a* is disposed to form a third application liquid chamber 235*c* between the first application liquid chamber 235*a* and the second application liquid chamber 235*b*. The application liquid chamber unit 235 also has third application liquid chamber ports 236*c*. As illustrated in FIG. 7, like the second application liquid chamber ports 236*b*, treatment liquid inflows from third collection liquid chamber ports 252*c* to a first collection liquid chamber 251*a* of the collection liquid chamber unit 251 via a third collection channel 253*c*. Such a configuration can separate foreign matter or paper dust adhered to the squeeze roller 233 in a stepwise manner.

It is to be noted that the number of separations between are not limited to one or two, but may be three or more. For example, in an exemplary embodiment in which a plurality of partitions is arranged between the first application liquid chamber and the second application liquid chamber, a fourth or more application liquid chambers, as well as the third application liquid chamber 235*c*, may be disposed between the first application liquid chamber 235*a* and the second application liquid chamber 235*b*, thus further reliably separating foreign matter or paper dust adhered to the squeeze roller 233 in a stepwise manner.

The liquid level of the application liquid chamber unit 235 (the first application liquid chamber 235*a*, the second application liquid chamber 235*b*, and/or the third application liquid chamber 235*c*) is monitored with a liquid-level detector. Based on detection results of the liquid-level detector, the pump 203 and the drain valve 257 are controlled. Additionally, a contamination detector is provided to detect the degree of contamination of the treatment liquid stored in the first application liquid chamber 235*a* and/or the first collection liquid chamber 251*a*. Based on detection results of the contamination detector, driving of the pump 203 is controlled to adjust the amount of the treatment liquid 201 supplied from the new treatment-liquid container 202. The contamination detector may be, for example, a transmittance detector to detect optical transmittance of the treatment liquid or a refraction detector to detect optical refractive index varying with the physical change of treatment liquid.

In the above-described embodiment, as illustrated in FIG. 5, the partition 237 is disposed in the application liquid chamber unit 235 to separate the first application liquid chamber 235*a* (the squeeze-roller side chamber) distal to the application roller 232 and the second application liquid chamber 235*b* (the application-roller side chamber) proximal to the application roller 232. The partition 237 extends in the axial direction of each of the shafts of the rollers. In the treatment liquid of the second application liquid chamber 235*b* formed with the partition 237, friction of the roller surface of the squeeze roller 233 with the treatment liquid creates the second liquid chamber vortex 242. Since the second application liquid chamber 235*b* is a relatively small space, the treatment liquid 201 stored in this space is stirred hard, thus increasing the flow speed. Thus, a shearing force greater than a conventional configuration is applied to the surface of the squeeze roller 233, forcibly and reliably separating foreign matter or paper dust adhered to the squeeze roller 233. Such a configuration prevents foreign matter or paper dust to enter the first application liquid chamber 235*a*, thus minimizing contamination of the treatment liquid.

Further, in the above-described exemplary embodiment, as illustrated in FIG. 4, the second application liquid chamber 235*b* communicates with the second collection liquid chamber 251*b* to discharge, to the second collection liquid chamber 251*b*, the treatment liquid 201 including foreign matter in the second application liquid chamber 235*b*. Such a configuration minimizes contamination of paper dust or other foreign matter to the treatment liquid in the first application liquid chamber 235*a*, thus allowing the treatment liquid to be stored in non- or less-contaminated state.

In the above-described exemplary embodiment, as illustrated in FIG. 6, the treatment-liquid application device 200 has the regulation plates 238 serving as regulation members to regulate the flow direction of the treatment liquid 201 in the second application liquid chamber 235*b*. The regulation plates 238 allows stirring of paper dust or foreign matter having sunk in the second application liquid chamber 235*b* and constantly creates liquid flow to apply pressure toward outer sides in the second application liquid chamber 235*b*. Such a configuration prevents settlement of foreign matter, thus minimizing entry of foreign matter to the treatment liquid 201 in the second application liquid chamber 235*b*.

In the above-described exemplary embodiment, as illustrated in FIG. 6, the first collection liquid chamber 251*a* and the second collection liquid chamber 251*b* are disposed at both ends of the first application liquid chamber 235*a* and the second application liquid chamber 235*b*. Such a configuration can minimize a difference in freshness of the treatment liquid 201 in the axial direction of the squeeze roller 233 and promptly discharge foreign matter to two chambers, thus resulting in an increased performance of discharging foreign matter.

Additionally, in the above-described exemplary embodiment, as illustrated in FIGS. 7 and 8, the third application liquid chamber 235*c* is disposed between the first application liquid chamber 235*a* and the second application liquid chamber 235*b*. Such a configuration allows stepwise separation of foreign matter or paper dust adhered to the squeeze roller 233 and fully remove foreign matter from the treatment liquid, thus further effectively minimizing contamination of the treatment liquid.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A treatment-liquid application device comprising:

a treatment-liquid container to store a treatment liquid;

a liquid supply unit to supply the treatment liquid from the treatment-liquid container;

a liquid chamber unit to store the treatment liquid supplied from the treatment-liquid container;

a treatment-liquid carrier having a carrying surface movable into and out from the treatment liquid stored in the liquid chamber unit to carry the treatment liquid;

a transport unit to transport an application target to an application position;

a treatment-liquid applicator to apply the treatment liquid transferred from the treatment-liquid carrier, to the application target at the application position; and a partition disposed in an area of the liquid chamber unit defined by an imaginary entry plane, an imaginary exit plane, the carrying surface, and a bottom face of the liquid chamber unit, the imaginary entry plane including an entry line at which the carrying surface of the treatment-liquid carrier enters the treatment liquid stored in the liquid chamber unit, the imaginary entry plane vertically extending from the entry line, the imaginary exit plane including an exit line at which the carrying surface of the treatment-liquid carrier exits from the treatment liquid stored in the liquid chamber unit, the imaginary exit plane vertically extending from the exit line, the partition extending in a longitudinal direction of the treatment-liquid carrier perpendicular to a moving direction of the carrying surface of the treatment-liquid carrier, the partition having an edge portion adjacent to the carrying surface of the treatment-liquid carrier.

2. The treatment-liquid application device of claim 1, wherein the partition divides the liquid chamber unit into a first liquid chamber and a second liquid chamber disposed at exit and entry sides, respectively, of the carrying surface of the treatment-liquid carrier relative to the treatment liquid stored in the liquid chamber unit, and the second liquid chamber has a capacity smaller than a capacity of the first liquid chamber.

3. The treatment-liquid application device of claim 2, further comprising:

a treatment-liquid collection chamber unit to store the treatment liquid collected from the second liquid chamber;

a communication channel to communicate the second liquid chamber with the first liquid chamber via the treatment-liquid collection chamber unit; and a foreign matter discharge assembly to discharge foreign matter included in the treatment liquid from the second liquid chamber to the treatment-liquid collection chamber unit and deliver the treatment liquid to the first liquid chamber through the communication channel.

4. The treatment-liquid application device of claim 3, wherein the foreign matter discharge assembly is disposed at both sides of the liquid chamber unit in the longitudinal direction of the treatment-liquid carrier.

5. The treatment-liquid application device of claim 3, further comprising a collection chamber partition that divides the treatment-liquid collection chamber unit into a first collection chamber and a second collection chamber, wherein the first collection chamber stores the treatment liquid collected from the first liquid chamber and the second collection chamber stores the treatment liquid collected from the second liquid chamber.

6. The treatment-liquid application device of claim 5, wherein the first collection chamber has a port communicating with the first liquid chamber at a position higher than a position of a port of the second collection chamber communicating with the second liquid chamber.

7. The treatment-liquid application device of claim 1, wherein, relative to a position vertically downward from a rotation center of the treatment-liquid carrier, the partition is disposed at an entry side at which the carrying surface of the treatment-liquid carrier enters the treatment liquid stored in the liquid chamber unit.

8. The treatment-liquid application device of claim 1, further comprising a regulation member forming at least one channel to regulate a flow direction of the treatment liquid.

9. The treatment-liquid application device of claim 8, wherein the at least one channel is oriented from a center side to an outer side in the longitudinal direction of the treatment-liquid carrier.

10. The treatment-liquid application device of claim 8, wherein the at least one channel is inclined at an angle relative to the partition and, as the at least one channel is farther from a center in the longitudinal direction of the treatment-liquid carrier, the angle becomes smaller.

11. The treatment-liquid application device of claim 8, wherein the regulation member is arranged in line symmetry with respect to a center line of the liquid chamber unit in the moving direction of the treatment-liquid carrier.

12. The treatment-liquid application device of claim 1, further comprising at least another partition disposed in the area of the liquid chamber unit defined by the imaginary entry plane, the imaginary exit plane, the carrying surface, and the bottom face of the liquid chamber unit, the at least one partition extending in the longitudinal direction of the treatment-liquid carrier and having an edge portion adjacent to the carrying surface of the treatment-liquid carrier.

13. An image forming apparatus, comprising:

the treatment-liquid application device of claim 1 to apply a treatment liquid to an application target; and an image forming device to form an image on the application target having the treatment liquid thereon.

14. A treatment-liquid application device comprising:

a treatment-liquid container to store a treatment liquid;

a liquid supply unit to supply the treatment liquid from the treatment-liquid container;

a liquid chamber unit to store the treatment liquid supplied from the treatment-liquid container;

a treatment-liquid carrier having a carrying surface movable into and out from the treatment liquid stored in the liquid chamber unit to carry the treatment liquid;

a transport unit to transport an application target to an application position;

a treatment-liquid applicator to apply the treatment liquid transferred from the treatment-liquid carrier, to the application target at the application position; and a partition disposed in the liquid chamber unit to partition the liquid chamber unit into upstream and downstream chambers in a moving direction of the carrying surface of the treatment-liquid carrier, the partition extending in a longitudinal direction of the treatment-liquid carrier perpendicular to the moving direction of the carrying surface of the treatment-liquid carrier, the partition having an edge portion adjacent to the carrying surface of the treatment-liquid carrier.

15. The treatment-liquid application device of claim 14, wherein the upstream chamber is smaller than the downstream chamber.

16. The treatment-liquid application device of claim 14, wherein, relative to a position vertically downward from a rotation center of the treatment-liquid carrier, the partition is disposed at an entry side at which the carrying surface of the treatment-liquid carrier enters the treatment liquid stored in the liquid chamber unit.

17. An image forming apparatus, comprising:

the treatment-liquid application device of claim 14 to apply a treatment liquid to an application target; and an image forming device to form an image on the application target having the treatment liquid thereon.

* * * * *